United States Patent [19]

Connolly

[11] 4,315,194

[45] Feb. 9, 1982

[54] COUPLED CAVITY TRAVELING WAVE TUBE WITH VELOCITY TAPERING

[75] Inventor: Denis J. Connolly, N. Olmsted, Ohio

[73] Assignee: The United States of America as represented by the Administrator of the National Aeronautics and Space Administration, Washington, D.C.

[21] Appl. No.: 122,966

[22] Filed: Feb. 20, 1980

[51] Int. Cl.[3] ..... H01J 25/34

[52] U.S. Cl. ..... 315/3.6; 315/3.5; 330/43

[58] Field of Search ..... 315/3.6, 3.5, 39.3; 330/43

[56] References Cited

U.S. PATENT DOCUMENTS

| | | | |
|---|---|---|---|
| 2,922,920 | 1/1960 | Convert | 315/3.6 |
| 3,068,425 | 12/1962 | Le Boutet et al. | 315/3.6 X |
| 3,274,428 | 9/1966 | Harris | 315/3.6 |
| 3,374,390 | 3/1968 | Ruetz et al. | 315/3.6 |
| 3,846,664 | 11/1974 | King et al. | 315/3.6 |
| 4,053,810 | 10/1977 | James | 315/3.6 |
| 4,147,956 | 4/1979 | Horigome et al. | 315/3.6 |
| 4,158,154 | 6/1979 | Gross | 315/3.6 |

*Primary Examiner*—Saxfield Chatmon, Jr.
*Attorney, Agent, or Firm*—Norman T. Musial; John R. Manning; James A. Mackin

[57] ABSTRACT

A coupled cavity traveling wave tube (10, 10') is provided having a velocity taper, i.e., gradual velocity reduction, which affords beam-wave resynchronization and thereby enhances efficiency. The required wave velocity reduction is achieved by reducing the resonant frequencies of the individual resonant cavities as a function of the distance from the electron gun (16, 16'), through changes in internal cavity dimensions. The required changes in cavity dimensions can be accomplished for example, by gradually increasing the cavity radius ($R_2$, $R_3$, $R_4$) or decreasing the gap length ($l_1$, $l_2$), from cavity to cavity. With this approach the velocity reduction is carried out without an increase in circuit resistive losses and the upper and lower cut off frequencies are reduced in approximately the same manner.

6 Claims, 7 Drawing Figures

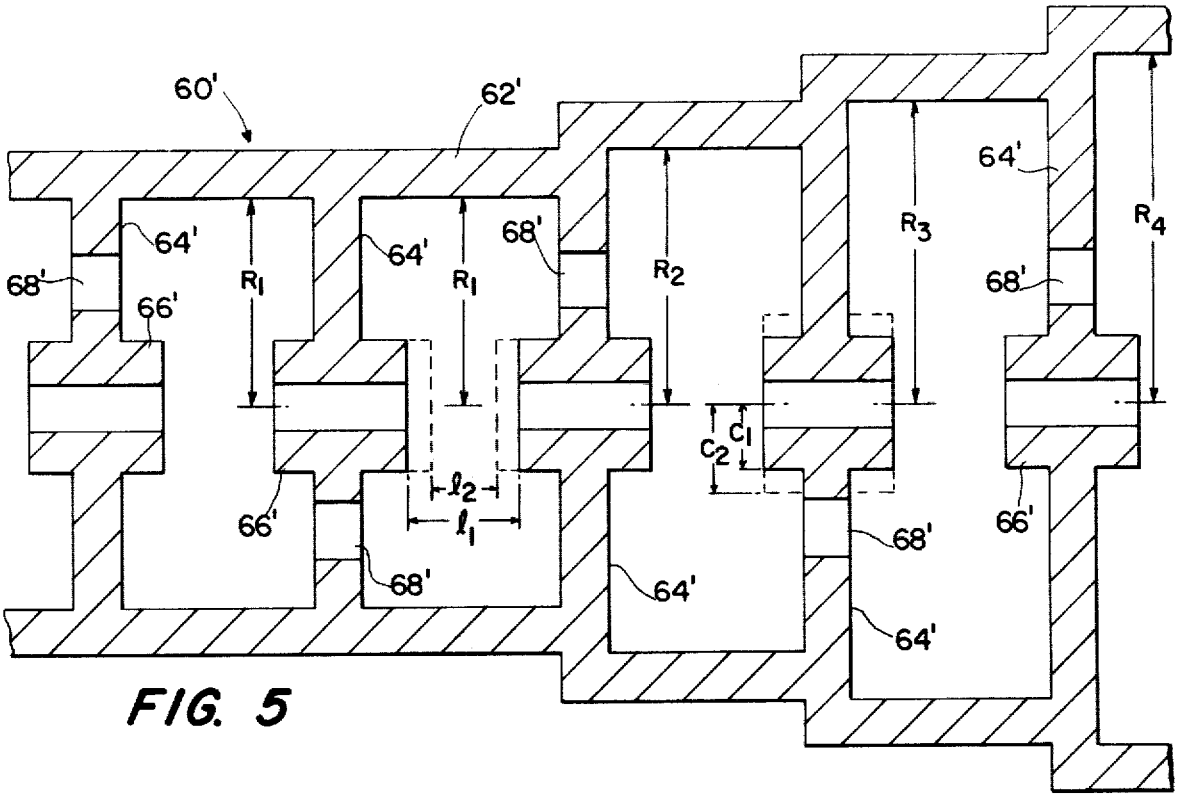
FIG. 5
FIG. 6
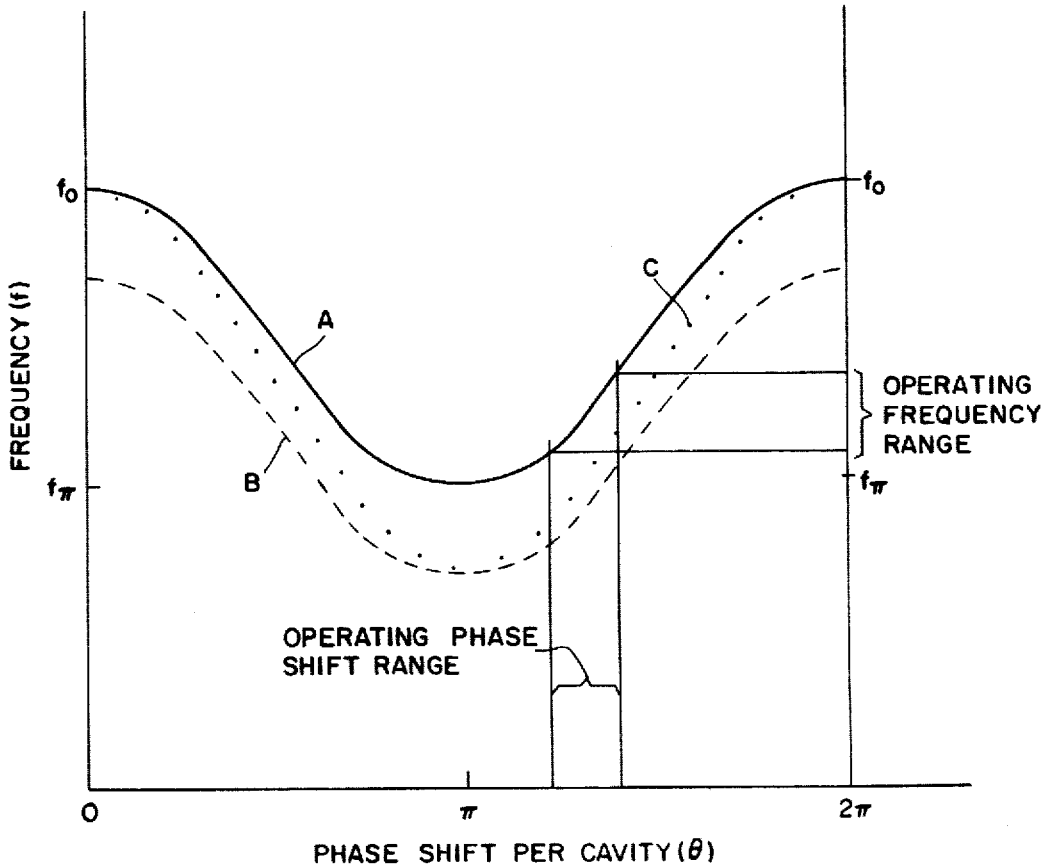

COUPLED CAVITY TRAVELING WAVE TUBE WITH VELOCITY TAPERING

ORIGIN OF THE INVENTION

This invention was made by an employee of the United States Government and may be used by or for the Government without the payment of any royalties thereon or therefor.

TECHNICAL FIELD

The present invention relates to coupled cavity traveling wave tubes (CCTWT's) and more particularly to an improved technique of providing velocity tapering and hence improving efficiency.

BACKGROUND ART

It is known that all types of traveling wave tubes (TWT's) tend to lose the desired synchronization between the electron beam and the interacting electromagnetic wave as the electron beam progresses along the slow wave structure (SWS). Such loss of beam-wave synchronization occurs at the expense of beam kinetic power and results in the loss of the desired traveling wave interaction, thereby limiting the attainable efficiencies.

Various methods have been proposed to delay the loss of synchronism and thereby enhance the efficiency of TWT's. One class of methods involves so-called velocity tapering, i.e., a gradual reduction in the SWS wave velocity near the output end of the TWT. With this approach the wave velocity and beam velocity decrease together, loss of synchronism is delayed, and TWT efficiency is thereby increased. In current practice the required velocity reduction is accomplished by a reduction in the periodic length of the SWS. This approach to TWT efficiency enhancement is discussed, for example, in the journal article "Improvement of Traveling Wave Tube Efficiency Through Period Tapering", N. H. Pond and R. J. Twiggs, IEEE Transactions on Electron Devices, Vol. ED-13, 1966, pp. 956–961.

Certain adverse effects limit the usefulness of period tapering as applied to cavity coupled traveling wave tubes. A large amount of period tapering may result in undesired oscillations in the CCTWT, as is discussed in more detail in the aforesaid Pond and Twiggs journal article. Furthermore, the reduction in periodic length provided by period tapering leads to an increase in Joule heating losses and a decrease in interaction impedance. Reference is made to "Calculation of Coupled-Cavity TWT Performance", J. R. M. Vaughn, IEEE Transactions on Electron Devices, Vol ED-22, 1975, pp. 880–890 for a further discussion of these effects.

A further approach to velocity tapering in TWT's having a coupled cavity slow wave structure is disclosed in U.S. Pat. No. 3,846,664 (King et al). In this patent the speed of travel of the applied r.f. wave is slowed so as to be substantially in step with the decreasing velocity of the electron beam by varying, in accordance with a predetermined tapering law, the resonant frequency of the coupling elements, i.e., slots, which couple the adjacent cavities of the slow wave structure. The main purpose of this approach is to provide frequency dependent velocity reduction so that higher frequencies have less velocity than lower frequencies with the result that the bandwidth is increased, i.e., the upper cut-off frequency remains the same and the lower cut-off frequency is reduced. A further patent of interest is U.S. Pat. No. 3,274,428 (Harris) which discloses a traveling wave tube having a band pass slow wave structure whose frequency characteristic varies along the length thereof, in order to inhibit oscillation. To accomplish this, the sizes of coupling apertures in partitions disposed transverse to the beam path are varied between maximum nearer the electron gun to a minimum nearer the collector electrode.

SUMMARY OF THE INVENTION

In accordance with the invention, a coupled cavity traveling wave tube includes a slow wave structure which provides velocity tapering that affords synchronization between the electron beam and the SWS wave so as to enhance the efficiency of the traveling wave tube. The velocity taper is achieved by a slow wave structure wherein the resonant frequencies of the individual resonant cavities is reduced as a function of the distance from the electron gun, this being done while maintaining the period of the slow wave structure unchanged and the bandwidth of the slow wave structure substantially unchanged. This graduated change in the resonant frequencies of the cavities can, for example, be accomplished by increasing the radius of the individual cavities as a function of distance from the electron gun. Other techniques of achieving the same result include decreasing the gap length and increasing the ferrule radius and various techniques can be used in different combinations.

As is explained in more detail hereinbelow, the coupled cavity traveling wave tube embodying the invention provides substantial advantages over the prior art. For example, coupled cavity traveling wave tubes which provide period tapering suffer disadvantages having to do with the rapid decrease in interaction impedance and increase in r.f. skin effect losses per cavity with decreasing circuit wave velocity. In contrast with the technique of the invention, this decrease in interaction impedance and increase in r.f. losses is reduced or eliminated. Moreover, in contrast to traveling wave tubes of the type disclosed in the King et al patent, the difference between the upper and lower cut-off frequencies remains about the same for the traveling wave tube of the invention so that, as stated above, the bandwidth remains substantially the same. As was discussed previously, in the traveling wave tube of the King et al patent, the bandwidth is increased, with the upper cut-off frequency remaining the same and lower cut-off frequency being reduced.

Other features and advantages of the invention will be set forth in or apparent from the detailed description of the preferred embodiments found hereinbelow.

BRIEF DESCRIPTION OF THE DRAWINGS

FIG. 5 is a longitudinal section of a portion of a CCTWT incorporating velocity tapering technique of the invention; and FIG. 6 is a series of beta-omega curves used in explaining the differences between the invention and the prior art.

DESCRIPTION OF THE PREFERRED EMBODIMENTS

Figure 1:
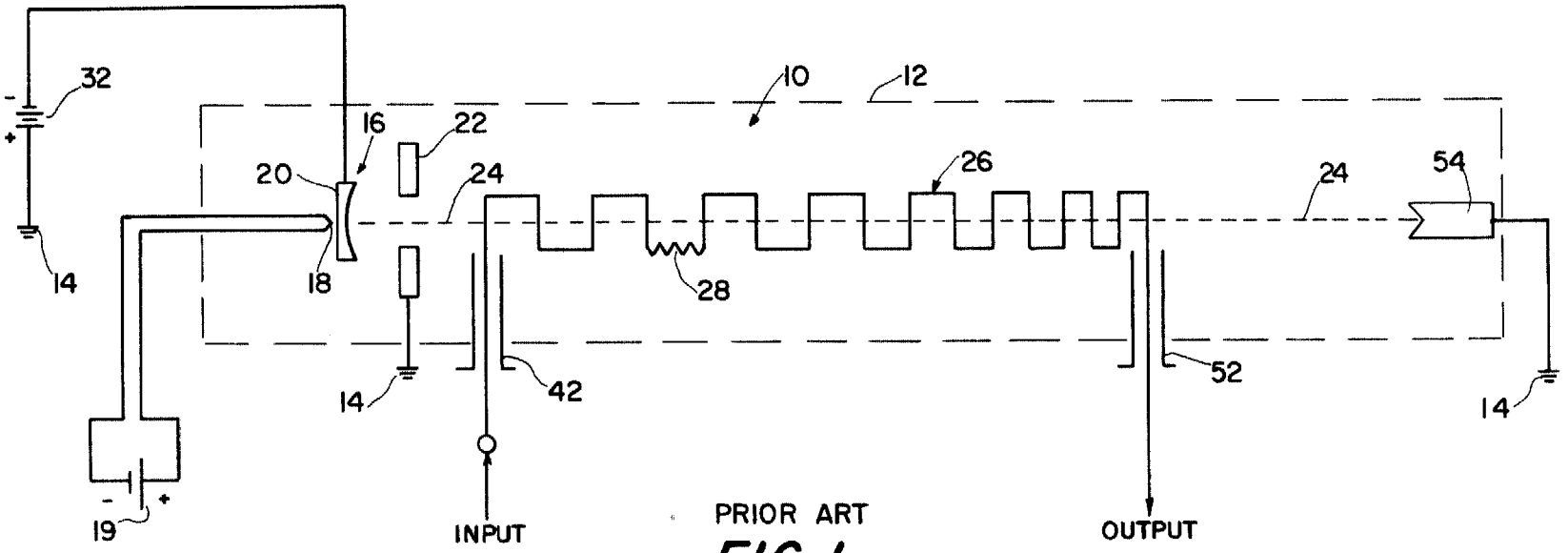
PRIOR ART FIG. 1
FIG. 1 is a schematic diagram of a conventional CCTWT employing period tapering.

Referring to FIG. 1, a conventional traveling wave tube (TWT), generally denoted 10, includes a vacuum envelope 12 which is preferably metallic. The TWT 10 also comprises an electron gun having a heater 18 energized by a suitable source indicated at 19, a cathode 20 heated by heater 18 to provide electrons, and an accelerating electrode 22 having an aperture therein through which electrons are transmitted from the cathode 20 so as to form a beam 24 of electrons. The cathode 20 is maintained at a suitable negative potential with respect to the accelerating electrode 22 by a suitable voltage source connected thereto and indicated at 32.

Figure 4A:
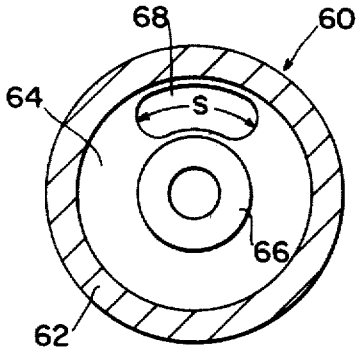
PRIOR ART FIG. 4(a)
FIGS. 4(*a*) and 4(*b*) are transverse and longitudinal sections, with portions broken away, showing the geometry of a typical CCTWT and illustrating the parameters which can be varied.
Figure 4B:
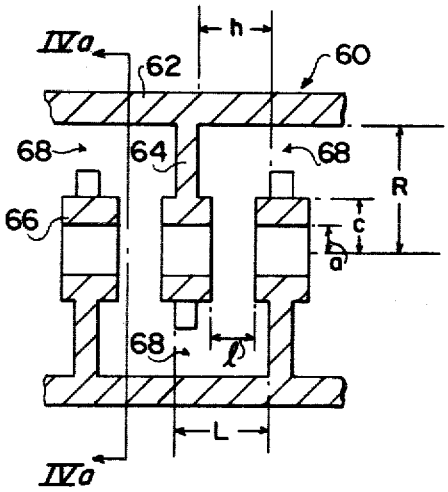
PRIOR ART FIG. 4(b)

The electron beam 24 passes through a slow wave structure (SWS) 26 depicted schematically in FIG. 1 by a meandering line formed by generally rectangular turns. The SWS 26 is of the coupled cavity type whose basic geometry is shown in FIGS. 4(*a*) and 4(*b*) discussed below. The SWS 26 may be interrupted by a sever 28 which absorbs backward wave power traveling along the SWS 26 in order to insure stability. The rectangular turns in the schematic depiction of the SWS 26 are shown as being gradually more closely spaced near the output end of the SWS 26, so as to indicate that the gradual reduction in circuit periodic length associated with the "period tapering" technique discussed above. The electron beam 24, after passing through the SWS 26, is collected by a conventional collector electrode 54.

An input coupler 42 is connected to receive the high frequency input signal to be amplified and provides appropriate impedance matching and coupling of input signal to the upstream end of SWS 26. An output coupler 52 couples the amplified output signal from the downstream end of the SWS 26 to an external load or suitable transmission line.

It will be understood that the showing in FIG. 1 is highly schematic in nature only and no significance should be attributed to exact geometric shapes, absolute or relative distances, or the number of "turns" in the various sections of the SWS 26.

Figure 2:
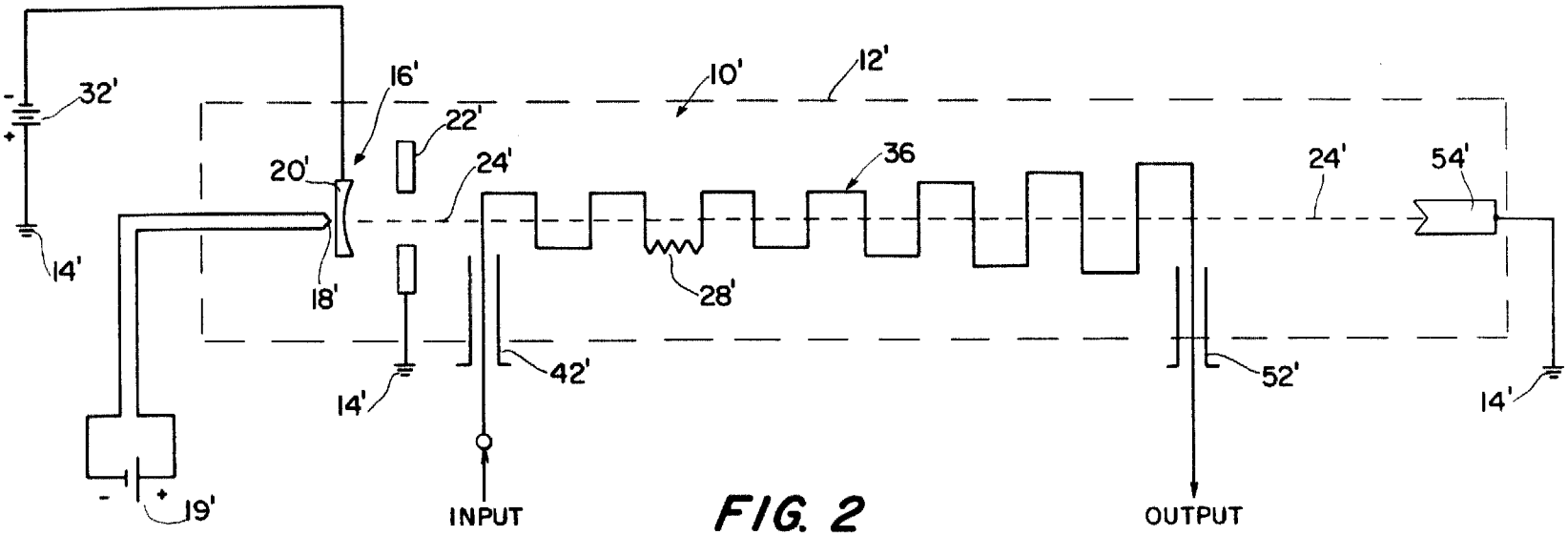
FIG. 2 is a schematic diagram similar to that of FIG. 2 incorporating phase delay tapering in accordance with the invention.

Referring now to FIG. 2, a traveling wave tube is shown wherein all components, save one, are similar to those shown in FIG. 1, and corresponding components in FIG. 2 have been given the same reference numerals as those in FIG. 1 but with primes attached. The only difference in the embodiments of FIGS. 1 and 2 concerns the construction of the slow wave structure, which is denoted 36 in FIG. 2. As shown, a constant spacing is maintained between the rectangular turns in the schematic depiction of the SWS 36 in the axial direction, i.e., in the direction along the electron beam. However, in the velocity taper region, i.e., the region beginning roughly midway along the length of SWS 36, the transverse excursions in the rectangular loops of schematic showing in FIG. 2 gradually increase in length, so as to indicate a gradual increase in phase delay per period.

The significance of the differences between the techniques illustrated schematically of FIGS. 1 and 2 will now be discussed. The SWS wave phase velocity is given by the formula $V_p=2\pi fL/\theta$ where "$V_p$" is the phase velocity, "f" is the frequency, "L" is the periodic length, and "$\theta$" is the phase shift per cavity. It will be appreciated from this equation that, at a given frequency, the phase velocity can be decreased either by decreasing the periodic length L or by increasing the phase shift per period $\theta$. The approach currently used for CCTWT's in actual practice is the former whereby L is decreased while holding $\theta$ more or less unchanged. This approach is represented schematically in FIG. 1 by SWS 26. The approach wherein $\theta$ is increased while holding L more or less unchanged is illustrated schematically in FIG. 2 by SWS 36. It will be understood that the illustration of this technique in FIG. 2 is schematic only and it should not be inferred from FIG. 2 that the increase in $\theta$ is necessarily associated with an increase in signal path length per period.

Figure 3:
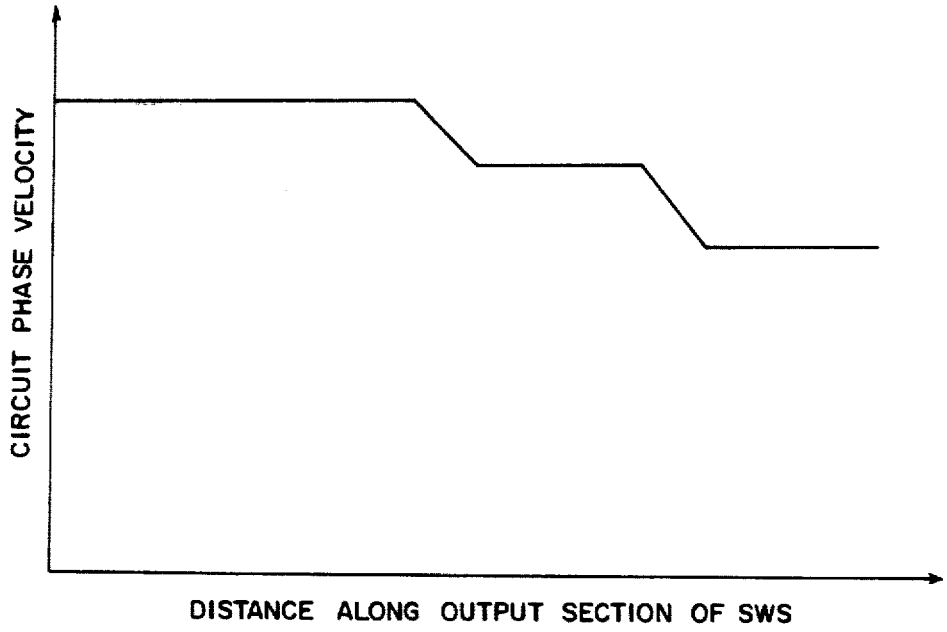
FIG. 3 is a diagram of a typical velocity profile.

Referring to FIG. 3, a typical velocity taper profile, i.e., a plot of circuit phase velocity as a function of the distance along the output section, is shown. In a method such as illustrated in FIG. 1, wherein period tapering is used, the plot corresponding to that of FIG. 3 would be of cavity periodic length as a function of cavity position, and the other cavity dimensions would be adjusted as necessary to keep $\Delta\theta$ constant. In the technique of FIG. 2, the corresponding plot would be of $1/\Delta\theta$ as a function of cavity position. Thus, the purpose of both of the embodiments is to achieve a velocity profile of the type shown in FIG. 3, but each uses a different technique to achieve this. As will be discussed below, the technique of the present invention, illustrated schematically in FIG. 2, provides substantial advantages over that illustrated in FIG. 1 as well as other techniques discussed above. Before discussing these advantages in more detail, the hardware used in carrying out the technique of the invention will now be considered.

Referring to FIGS. 4(*a*) and 4(*b*), there is illustrated the geometry of a typical conventional CCTWT of the backward fundamental wave type with mainly inductive coupling between cavities. The slow wave structure illustrated, which is generally denoted 60, includes an outer cylinder wall 62 and a series of resonant cavity-forming partitions 64 each having a ferrule or annulus 66 formed therein through which the electron beam passes and a slot 68 therein through which the high frequency electromagnetic wave is coupled between cavities, the slots 68 being alternately disposed on opposite sides of the corresponding ferrule 66 as illustrated in FIG. 4(*b*). In the illustrated slow wave structure, the cavity radius is denoted R, the beam tunnel radius a, the periodic length L, the gap length 1, the ferrule radius c, the cavity length h and the slot length S. As discussed above, the present invention involves the gradual reduction of the cavity resonant frequency while maintaining the period unchanged and maintaining the circuit bandwidth more or less unchanged. This gradual variation in the resonant frequencies of the cavities is accomplished by appropriately varying the physical dimensions of the individual cavities. Preferably this is done by increasing the radius R, decreasing the gap length 1 and/or varying the ferrule radius c. It will be appreciated that this approach contrasts with period taper techniques discussed above wherein the periodic length L is varied and the technique disclosed in the King et al. patent discussed above wherein the slot length S is varied.

A construction corresponding to that discussed hereinabove in general terms in connection with FIGS. 4(*a*) and 4(*b*) for providing a gradual variation of the cavity resonant frequency is illustrated in FIG. 5. The slow wave structure illustrated in FIG. 5 is similar to that of FIGS. 4(*a*) and 4(*b*) and corresponding elements have been given the same reference numerals with primes attached. As illustrated, the cavity radiis of the first two cavities shown are equal ($R_1$) while the radii for the next three cavities ($R_2$, $R_3$, and $R_4$) progressively increase from left to right so that the resonant frequencies of the corresponding cavities decrease in the same order. FIG. 5 also illustrates, in dashed lines, a decrease in the gap length (compare $1_1$ and $1_2$) and an increase in the ferrule radius (compare $c_1$ and $c_2$). As noted, any and all of these techniques can be used to provide the desired end result.

Referring to FIG. 6, so-called "omega-beta" curves are shown for coupled cavity slow wave structures of the backward fundamental type, the curves illustrating only the range from $\theta=0$ to $\theta=2\pi$. It will be understood the curves repeat themselves indefinitely in either direction (right and left). The solid curve (curve A) extends from the lower cut-off frequency, $f_\pi$, to the upper cut-off frequency $f_0$. Outside of this frequency range the slow wave structure represented by curve A will not allow waves to propagate. The dashed curve B and the dotted curve C represent modifications of curve A accomplished by altering the geometry of the SWS. It will be noted that curve B, which corresponds to the SWS of the invention, has the same shape as curve A but is uniformly lower in frequency. Curve C, which corresponds to the SWS of the King et al. patent discussed above, has the same upper cut-off frequency as curve A but the lower cut-off frequency is reduced and the curve is "stretched" in the frequency direction. It will be seen that for the operating frequency range depicted both curve B and curve C provide an operating phase shift range at higher values of $\theta$ than does curve A.

Curve B is shifted downward in frequency from curve A by changing the cavity dimensions as discussed above (e.g., by increasing the cavity radius R, decreasing the gap length 1, and/or increasing ferrule radius c) to thereby lower the resonant frequency of the cavities in a direction toward the collector electrode. Similarly a cavity chain with a f-$\theta$ relationship like that of curve C is provided by increasing the slot length S thereby lowering the resonant frequency of the coupling slots as provided in the King et al patent discussed previously. Inspection of FIG. 6 shows that both curve B and curve C provide an increase in $\theta$ at constant f and thus serve to reduce SWS wave velocity. However, the approach represented by curve B is more advantageous than that represented by curve C for at least two reasons. First, the velocity reduction is more nearly uniform at all frequencies within the operating frequency range for curve B, as is evident from inspection of FIG. 6. Second, curve C provides a larger propagating frequency range (SWS bandwidth) than curve B and therefore, curve C will have a lower interaction impedance than curve B. In general, the approach provided in accordance with the invention is superior to that represented by curve C particularly when applied to modest bandwidth CCTWT's where the SWS passband is much larger than the bandwidth of the operating frequency range.

It is noted that the velocity taper technique of the invention is compatible with prior art techniques and can be used in combination with such techniques depending on the application and the result desired.

Although the invention has been described in relation to exemplary embodiments thereof, it will be understood by those skilled in the art that variations and modifications can be effected in these exemplary embodiments without departing from the scope and spirit of the invention.

What is claimed is:

1. A coupled cavity traveling wave tube comprising an electron gun for producing an electron beam, a collector electrode for receiving the electrons of an electron beam produced by said electron gun, and a slow wave structure positioned between said electron gun and said collector electrode through which said electron beam and a high frequency electromagnetic wave passes, said slow wave structure comprising a plurality of serially coupled resonant cavities provided with coupling slots and ferrules the inside diameters of which serve as beam tunnels, and, excepting periodic length, ferrule inside diameter and slot length, one or more of the physical dimensions of each of the cavities from a point where loss of beam-wave synchronization begins to occur to the end of the tube adjacent to the collector being varied with respect to one another as a function of the distance from the electron gun such that the resonant frequency of each of these cavities in succession is reduced with the distance from the electron gun while the period of the slow wave structure remains unchanged and the bandwidth of the slow wave structure remains substantially unchanged, to thereby provide velocity tapering of said electromagnetic wave and resultant improved electron beam-electromagnetic wave synchronization.

2. A coupled cavity traveling wave tube as claimed in claim 1 wherein said cavities whose physical dimensions are varied have different cavity radii, the radii of each successive one of the cavities increasing with distance from the electron gun.

3. A coupled cavity traveling wave tube as claimed in claim 1 wherein the cavities whose physical dimensions are varied have different gap lengths therebetween, the gap lengths decreasing with distance from the electron gun.

4. A coupled cavity traveling wave tube as claimed in claim 1 wherein the cavities whose physical dimensions are varied have ferrules of different outer radii, the outer radii of the ferrules increasing with distance from the electron gun.

5. A coupled cavity traveling wave tube as claimed in claim 2 wherein the gap lengths between at least two of the resonant cavities decrease with distance from the electron gun.

6. A coupled cavity traveling wave tube as claimed in claim 3 wherein the radii of at least two of the resonant cavities increase with distance from the electron gun.

* * * * *